US005877386A

United States Patent [19]

Schubert

[11] Patent Number: 5,877,386

[45] Date of Patent: Mar. 2, 1999

[54] METHOD FOR SWEETENING OF LIQUID PETROLEUM GAS BY CONTACTING WITH TEA AND ANOTHER AMINE

[75] Inventor: Craig Norman Schubert, Belle Mead, N.J.

[73] Assignee: Union Carbide Chemicals & Plastics Technology Corporation, Danbury, Conn.

[21] Appl. No.: 539,554

[22] Filed: Oct. 5, 1995

[51] Int. Cl.[6] ..... C07C 7/00; C01B 17/16

[52] U.S. Cl. ..... 585/860; 423/228

[58] Field of Search ..... 585/860; 423/228

[56] References Cited

U.S. PATENT DOCUMENTS

| | | | |
|---|---|---|---|
| 3,856,921 | 12/1974 | Shrier et al. | 423/228 |
| 4,233,141 | 11/1980 | Beavon et al. | 208/236 |
| 4,466,946 | 8/1984 | Goddin, Jr. et al. | 423/228 |
| 4,529,411 | 7/1985 | Goddin, Jr. et al. | 55/16 |
| 4,749,555 | 6/1988 | Bush | 423/228 |
| 4,808,765 | 2/1989 | Pearce et al. | 585/860 |
| 4,970,344 | 11/1990 | Keller | 564/497 |
| 4,990,712 | 2/1991 | Harandi et al. | 585/324 |
| 5,162,084 | 11/1992 | Cummings et al. | 210/662 |
| 5,190,662 | 3/1993 | Keller et al. | 210/673 |
| 5,209,914 | 5/1993 | Peytavy et al. | 423/228 |
| 5,246,619 | 9/1993 | Niswander | 423/228 |
| 5,368,818 | 11/1994 | Cummings et al. | 422/62 |

FOREIGN PATENT DOCUMENTS

| | | | |
|---|---|---|---|
| 1304911 | of 0000 | Canada | C07C 7/11 |
| 3430980 | 3/1986 | Germany | B01D 53/34 |

OTHER PUBLICATIONS

"*Design and Operation of Liquid/Liquid Treating Units*", Richard M. Russell, Exxon Production Research Co., Houston Texas, 1979 Gas Conditioning Conference No month available.

"*The Evaluation and Design of LPG Treaters*", J. Tse and J. Santos, Dow Chemical Co., GAS/SPEC Technology Group, Freeport, Texas, presented at 43rd Annual L. Reid Gas Conditioning Conference Mar. 1–3,1993, Norman, Okla No month available.

*Primary Examiner*—Glenn Caldarola
*Assistant Examiner*—In Suk Bullock
*Attorney, Agent, or Firm*—S H Hegedus

[57] ABSTRACT

A method and composition for treating liquefied petroleum gas containing acid gases such as $H_2S$, $CO_2$, and COS to sweeten such liquefied petroleum gas by removal of a substantial portion of such acid gases while minimizing losses of amines due to solubility in LPG and enhancing $CO_2$ slip, said method comprising contacting said liquefied petroleum gas with an absorbent mixture comprising an aqueous solution of TEA and at least another amine preferably selected from the group consisting of MEA, DEA, MDEA, DIPA, and mixtures thereof.

4 Claims, 3 Drawing Sheets

METHOD FOR SWEETENING OF LIQUID PETROLEUM GAS BY CONTACTING WITH TEA AND ANOTHER AMINE

BACKGROUND OF THE INVENTION

Petroleum gas often contains a variety of acidic, gaseous contaminants, of which the principal ones are hydrogen sulfide, mercaptans and other diverse sulfur compounds, carbon dioxide, and carbonyl sulfide (COS). It is well known in the gas treating industry that such contaminants can be successfully removed by contacting the gas with aqueous solutions of one or more amines, which may be either selective or non-selective in their ability to absorb various of the acid gases. After such absorption, the acidic compounds are stripped from the amines and the amines are returned to the system, except to the extent they may have been lost in the process. It has been theorized that many different amines would provide some level of utility for removal of acid gases, but as a practical matter, the amines actually in commercial use are monoethanolamine (MEA), diethanolamine (DEA), methyldiethanolamine (MDEA), and diisopropanolamine (DIPA). Triethanolamine (TEA) is also frequently disclosed in the art as useful in gas treatment, but its actual commercial use appears to be very limited to non-existent. Use of MDEA/DIPA mixtures has also been reported (U.S. Pat. No. 4,808,765) for the purpose of removing $H_2S$ and COS from liquefied petroleum gas (LPG). More specifically, U.S. Pat. No. 4,808,765 teaches that MDEA, a selective $H_2S$ absorbant, may be formulated with DIPA, a COS absorbent, to reduce amine losses due to solubility in LPG. This patent also teaches that MDEA is less soluble than MEA or DEA in liquid hydrocarbons.

Treatment of LPG presents particular problems in that amines tend to be significantly soluble in the LPG, leading to a corresponding economic penalty due to the need to make up the lost amine(s). Many refineries use aqueous DIPA or MDEA to remove the acidic impurities from LPG; however, the concentration of these amines is typically limited to the range of about 20–35 weight percent of the aqueous stream in which they are supplied to the process. Operation at higher concentrations, which is desirable for capacity reasons, generally results in undesirably high levels of LPG contamination with amine(s). The problem is particularly acute at refineries treating cracked (i.e., highly unsaturated) LPG. Often, the loss rate of MDEA is sufficient to negate the economic justification for substituting MDEA for DEA. In addition to the high amine replacement costs, specialized remediation equipment is required, which increases the financial burden. Moreover, failure to remove dissolved MDEA can negatively affect downstream processes, e.g., poisoning of alkylation catalyst beds, and the like.

It would be highly desirable to have an amine composition which maximizes the effective amine concentration circulating in the LPG system, while yet minimizes the amount of amine(s) lost due to solubility in the LPG and increases desirable $CO_2$ slip.

SUMMARY OF THE INVENTION

The present invention provides such advantages. Accordingly, the present invention relates to a method for treating liquefied petroleum gas containing acid gases such as $H_2S$, $CO_2$, and COS to sweeten such liquefied petroleum gas by removal of a substantial portion of such acid gases while minimizing losses of amines due to solubility in LPG and enhancing $CO_2$ slip, said method comprising contacting said liquefied petroleum gas with an absorbent mixture comprising an aqueous solution of TEA and at least another amine selected from the group consisting of MEA, DEA, MDEA, DIPA, and mixtures thereof. The invention further provides a composition useful in such method.

DESCRIPTION OF THE INVENTION

Figure 1:
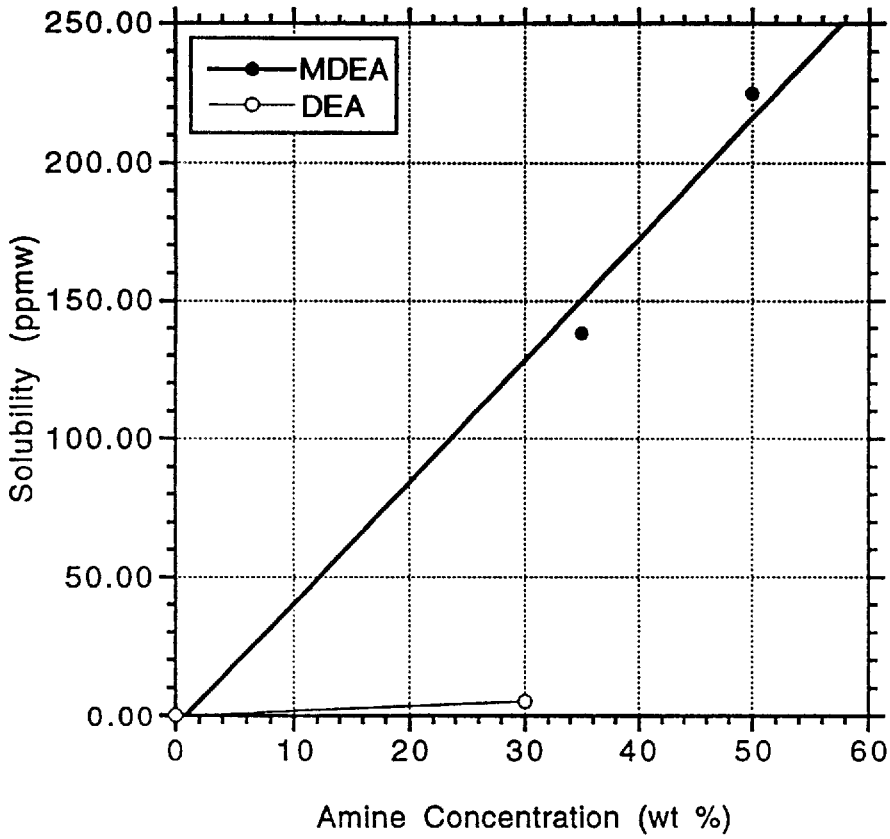
FIGS. 1 and 2 provide a comparison of the solubility of MDEA and DEA in cracked LPG at different concentrations.
Figure 2:
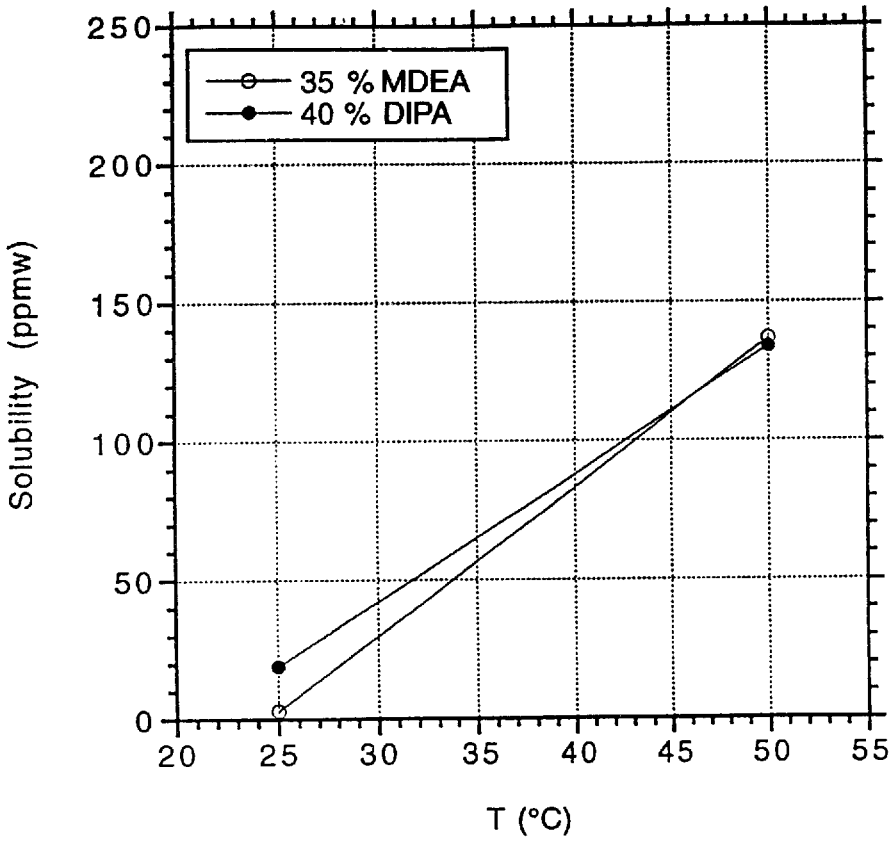
Figure 3:
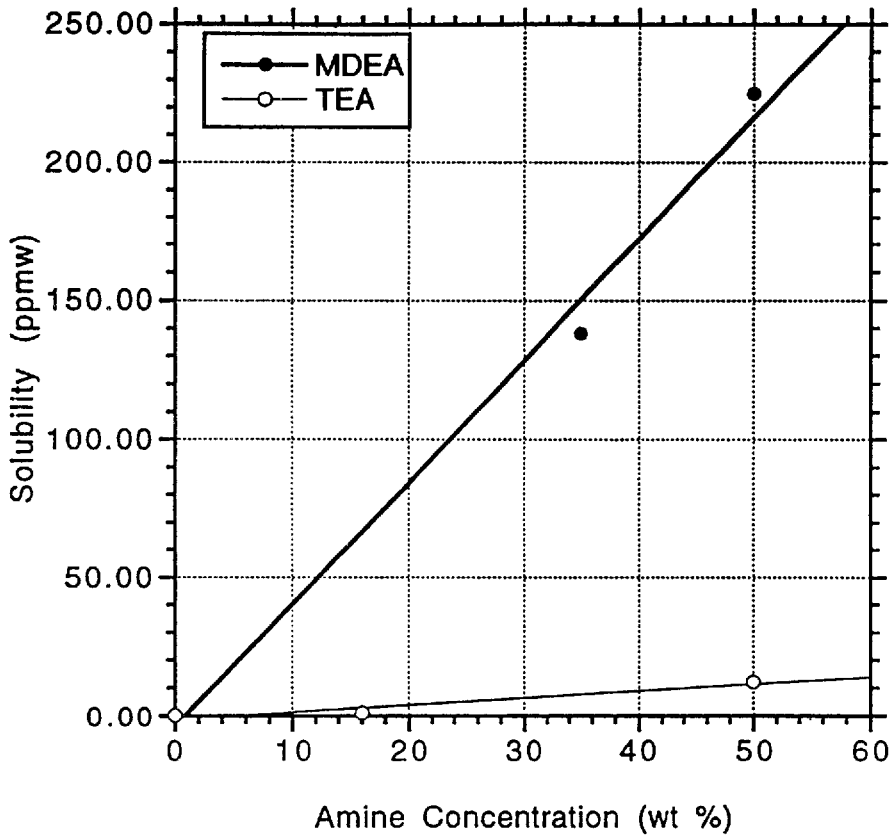
FIG. 3 provides a comparison of the solubility of MDEA and TEA in cracked LPG.

As has been mentioned, a principal disadvantage of the amines commonly used in the prior art is their relatively high solubility in LPG. The present invention addresses that problem by substituting a portion of the relatively high-solubility amine(s) with TEA. The high solubility of MDEA and DIPA is shown in FIGS. 1 and 2. It has been found, however, that the solubility of TEA is surprisingly low (see FIG. 3). It has now been found that the substitution of TEA for at least some of the other amines will provide increased capacity while yet reducing the loss of all the amines due to dissolution in the LPG.

Most refineries operate at a total amine concentration of no more than about 35% by weight of the amine-containing, aqueous treatment composition. Operation at about 40%, preferably even about 50% total amine(s) or more is desirable since high strength solutions provide additional acid gas removal capacity at low cost. Also, it is likely that the concentration of sulfur in crude oil will rise in the future; accordingly, in order to maintain or increase production, the refinery must, on the average, process/remove more sulfur. Nevertheless, because of the increased loss of amines at the higher concentrations, it has not been economically feasible to operate above about the 35% level in most cases. It is an advantage of the present invention that it allows the refinery to operate economically at higher total amine strengths without the high amine replacement costs they would otherwise incur.

According to the present invention, TEA is admixed, in aqueous solution, with either MDEA or DIPA, or a mixture of MDEA and DIPA, and/or other amines, and the mixture is directly substituted for the prior MDEA or other amine solution in the treatment process. As will be understood by those skilled in the art, TEA may alternatively be added directly to the process streams, thereby forming the TEA/amine mixtures of this invention in situ.

The process of this invention may be readily implemented by contacting LPG with the TEA mixture in ordinary liquid-liquid contacting equipment, and under operating conditions within the ordinary limitations of such equipment. While some optimization of conditions, within the skill of the art, should preferably be done, it is to be expected that a reduction in amine solubility losses will be experienced even at existing operating conditions. A further advantage of the present invention, therefore, is that it does not require significant substitutions or modifications in equipment, packing, operating conditions, and the like. Accordingly, the present invention is particularly beneficial to refineries which need more acid gas removal capacity, but are reluctant to pay for extensive capital upgrades.

It is another advantage of this invention that operating parameters are not narrowly critical. As a general guideline, it may be said that the higher the concentration of TEA in the system, the lower will be the amine losses. While there is no known specific upper limit on TEA concentration, it is suggested that the TEA concentration be held to no more than about 95 weight % of the amine mixture (on a water-free basis) in order to avoid operational problems, such as inadequate removal of $H_2S$. A useful approach to determining the maximum usable concentration of TEA in a given system is to gradually increase the TEA content until problems are detected, then back off on the TEA concentration until such problems disappear. Similarly, there is no necessary minimum concentration of TEA; it will be a matter of routine experimentation. It is suggested, however, as a starting point that the TEA concentration be at least about 20%. It is believed that, in the majority of cases, the useful range of TEA concentrations will be about 20 to about 90%, preferably about 30 to about 80%, and more preferably about 40 to about 60 weight % of the amine mixture, all on a water-free basis.

The operating temperature for the contacting of the LPG with the TEA-containing amine mixture is not narrowly critical, but will usually be in the range of about 50° to about 190° F., preferably about 80° to about 160, and more preferably about 90° to about 140° F. In general terms, the lower temperatures are preferred in order to minimize solubility losses. Since most refineries do not have much flexibility in this regard, it is an advantage of this invention that significant reduction in amine loss will be effected at any given operating temperature.

EXAMPLES

In order to establish a model composition for tests of cracked LPG, typical compositions were sampled from several commercial refineries in the U.S. and Europe. The compositions were averaged, resulting in the following composition which was used for the examples presented below:

| Component | Concentration, Mole % |
|---|---|
| Propane | 14 |
| Propylene | 30 |
| n-Butane | 24 |
| 1-Butene | 32 |

Example 1

The amine or mixture to be tested was dissolved in water and charged to an equilibrium cell, and the above hydrocarbon composition was thereafter charged to the cell, and the cell was brought to constant temperature. The contents of the cell were agitated for two hours, and thereafter six hours were allowed for phase separation. Samples of the liquid hydrocarbon were drawn into a sample cylinder and analyzed for amine by gas chromatography. The results of these measurements are depicted in the Figures, which show amine solubility as a function of concentration in the aqueous phase. These data show that the solubility of MDEA is similar to that of DIPA, both of which are much higher than that of TEA.

Example 2

The use of a prior art amine solvent comprising an aqueous solution of 44% by weight MDEA was compared with a solvent of this invention comprising an aqueous solution of 22% by weight MDEA and 35% by weight TEA (equivalent to 39% by weight MDEA and 61% by weight TEA on a water-free basis). Working at a commercial refinery, a run of steel tubing was installed to allow the sample point to be purged to a flare header prior to sampling at the inlet and outlet of the coalescer, which was operating at about 110° F. Because any field sampling is difficult to execute with accuracy, multiple containers were filled and analyzed by GC, and the average of the measurements is shown in the table below:

| | Average Amine Content in LPG (ppmw) | |
|---|---|---|
| Solvent | Coalescer Inlet | Coalescer Outlet |
| Prior Art | 303 | 311 |
| Invention | 119 | 110 |

For the prior art solvent, the spread between the high and low results showed a standard deviation of 23 ppm; the standard deviation for the solvent of this invention samples was 48 ppm. Since the inlet and outlet values are essentially equal, it indicates that the amine concentration was already at its solubility limit when the LPG entered the vessel. The key observation, however, is that the use of the solvent of this invention, reduced the amine loss in the olefins stream by a factor of about two-thirds, even though the amine concentration of the inventive solvent employed had been considerably higher than that of the prior art. It was also observed that a very significant increase in desirable $CO_2$ slip occurred for the solvent of this invention.

What is claimed is:

1. A method for treating liquefied petroleum gas containing acid gases such as $H_2S$, $CO_2$, and COS to sweeten such liquefied petroleum gas by removal of a substantial portion of such acid gases while minimizing losses of amines due to solubility in LPG and enhancing $CO_2$ slip, said method comprising contacting said liquefied petroleum gas with an absorbent mixture comprising an aqueous solution of TEA and at least another amine selected from the group consisting of DEA, MDEA, DIPA, and mixtures thereof.

2. A method of claim 1 wherein the contacting is conducted at a temperature of about 50° F. to about 190° F.

3. A method of claim 1 wherein the concentration of the TEA is about 20% to about 90 weight % of the amine mixture on a water-free basis.

4. A method of claim 1 wherein the concentration of amines in the aqueous treatment solution is greater than about 35% by weight.

* * * * *